US012144416B2

(12) United States Patent
De Bardonneche

(10) Patent No.: US 12,144,416 B2
(45) Date of Patent: Nov. 19, 2024

(54) DEVICE FOR APPLICATION OF A FLUID PRODUCT

(71) Applicant: SOCIETE INDUSTRIELLE DE MATIERES PLASTIQUES, ZAC du Plessis-Saucourt (FR)

(72) Inventor: Eric De Bardonneche, Montaren-et-Saint-Médiers (FR)

(73) Assignee: SOCIETE INDUSTRIELLE DE MATIERES PLASTIQUES, ZAC du Plessis-Saucourt (FR)

( * ) Notice: Subject to any disclaimer, the term of this patent is extended or adjusted under 35 U.S.C. 154(b) by 615 days.

(21) Appl. No.: 17/275,616

(22) PCT Filed: Sep. 19, 2019

(86) PCT No.: PCT/FR2019/052201
§ 371 (c)(1),
(2) Date: Mar. 11, 2021

(87) PCT Pub. No.: WO2020/058645
PCT Pub. Date: Mar. 26, 2020

(65) Prior Publication Data

US 2022/0047067 A1 Feb. 17, 2022

(30) Foreign Application Priority Data

Sep. 19, 2018 (WO) ..... PCT/FR2018/052289

(51) Int. Cl.
*A46D 1/00* (2006.01)
*A45D 34/04* (2006.01)
(Continued)

(52) U.S. Cl.
CPC ..... *A46D 1/0253* (2013.01); *A45D 34/042* (2013.01); *A45D 40/262* (2013.01); *A46B 9/021* (2013.01); *A46B 2200/1053* (2013.01)

(58) Field of Classification Search
CPC . A46B 9/021; A46B 9/028; A46B 2200/1053; A45D 40/265; A45D 40/262
See application file for complete search history.

(56) References Cited

U.S. PATENT DOCUMENTS 8,950,413 B2 * 2/2015 Kulik ..... A46B 3/005 132/901
2011/0229246 A1 * 9/2011 Kulik ..... A46B 9/021 132/218

(Continued)

FOREIGN PATENT DOCUMENTS

CN 108289542 7/2018
CN 108289542 A * 7/2018 ..... A45D 34/045

(Continued)

OTHER PUBLICATIONS

Search Report issued in Int'l Application No. PCT/FR2019/052201 (2019).

(Continued)

*Primary Examiner* — Marc Carlson
(74) *Attorney, Agent, or Firm* — Barnes & Thornburg LLP; G. Peter Nichols

(57) ABSTRACT

An applicator device for applying a fluid or paste product to keratin fibres or to the skin (epidermis), that includes an elongate core which extends along a longitudinal axis X and has a longitudinal cylindrical shape and a plurality of projections distributed across said core, each projection extending from an anchoring end in the core towards a free end and being integral with said core, and each projection having, at the free end, a means for the uptake and retention of a quantity of fluid or paste product.

15 Claims, 3 Drawing Sheets

(51) Int. Cl.
*A45D 40/26* (2006.01)
*A46B 9/02* (2006.01)

(56) References Cited

U.S. PATENT DOCUMENTS

| | | | | |
|---|---|---|---|---|
| 2017/0020274 | A1 | 1/2017 | De Bardonneche et al. | |
| 2017/0027304 | A1 | 2/2017 | Schreiber et al. | |
| 2017/0049215 | A1 | 2/2017 | Crapet et al. | |
| 2018/0116388 | A1* | 5/2018 | De Bardonneche | A46B 3/005 |
| 2018/0242714 | A1* | 8/2018 | De Bardonneche | A46B 9/021 |
| 2018/0368556 | A1* | 12/2018 | Berhault | A45D 40/267 |
| 2019/0254407 | A1* | 8/2019 | Scalciarini | A46B 9/021 |
| 2022/0047067 | A1* | 2/2022 | De Bardonneche | A46D 1/0253 |

FOREIGN PATENT DOCUMENTS

| | | | | |
|---|---|---|---|---|
| CN | 112702936 A | * | 4/2021 | A45D 34/042 |
| CN | 112702936 B | * | 11/2022 | A45D 34/042 |
| DE | 202010017160 U1 | * | 5/2012 | A45D 40/262 |
| EP | 3123898 | | 2/2017 | |
| EP | 3132709 | | 2/2017 | |
| EP | 3132709 A1 | * | 2/2017 | A45D 40/267 |
| EP | 3123898 B1 | * | 9/2019 | A45D 40/262 |
| FR | 2937514 | | 10/2008 | |
| FR | 2937514 A1 | * | 4/2010 | A45D 40/262 |
| FR | 3011168 A1 | * | 4/2015 | A46B 9/021 |
| FR | 3032869 A1 | * | 8/2016 | A45D 40/262 |
| IT | MI20082197 | | 6/2010 | |
| WO | 2015/110853 | | 7/2015 | |
| WO | WO-2015110853 A1 | * | 7/2015 | A46B 9/021 |
| WO | WO-2020058583 A1 | * | 3/2020 | |
| WO | WO-2020058645 A1 | * | 3/2020 | A45D 34/042 |
| WO | WO-2023275445 A1 | * | 1/2023 | |

OTHER PUBLICATIONS

English Translation of Office Action issued in Appl. No. CN201980060251 (Apr. 20, 2022).

* cited by examiner

DEVICE FOR APPLICATION OF A FLUID PRODUCT

This application is a U.S. nationalization under 35 U.S.C. § 371 of International Application No. PCT/FR2019/052201, filed Sep. 19, 2019, which claims priority to International Patent Application No. PCT/FR2018/052289, filed Sep. 19, 2018; the entire contents of each are incorporated herein by reference.

TECHNICAL FIELD OF THE INVENTION

The invention relates to an applicator device for applying a fluid or pasty product to keratin fibers or to an epidermis. In particular, the invention relates to an applicator device for applying a cosmetic, makeup or care product to the hair, eyelashes, eyebrows, skin or lips.

PRIOR ART

There currently exist applicator devices for applying a product of the fluid or pasty type to keratin fibers, such as mascara brushes for example, comprising a central core of elongate shape extending along a longitudinal axis, at least one row of elongate spikes comprising a first end embedded in the core and a second, free end. Usually, the spikes and the core are formed in one piece by molding, being materially integral with one another. For example, the document FR 2 937 514 describes such applicator devices. A drawback of this type of embodiment is that the spikes are arranged in such a way that the product to be applied is retained at the embedded end, close to the core, specifically once the wiper has been passed. Thus, the product to be applied is located mostly close to the core of the brush of the applicator device, away from the free end of the spikes. This is because, while passing through the wiper, the latter are completely wiped, cleared of the product to be applied. This causes the user, in the case of keratin fibers for example, to apply a certain force to ensure that the keratin fibers pass between the spikes so as to be as close to the core of the applicator device as possible in order to be correctly coated in product. There are also risks of the spike pricking, for example, the eyelid when applying makeup to the eyelashes, or the skin during treatment of the eyebrows, or the lips or the scalp, etc.

One solution to this problem was to provide an applicator device in which the core of the brush has an enlarged diameter. In order to allow the brush to pass through the wiper, the diameter of the latter was consequently increased. The drawback of this solution is that it brings about a large increase in the load of product to be applied which, once the wiper has been passed, remains mostly in the region of the core. During use, such an applicator device leaves unsightly lumps of product on the keratin fibers thus treated.

SUMMARY OF THE INVENTION

One aim of the invention is to provide an applicator device for applying a fluid or pasty product that allows optimal application of the product while giving its user a more comfortable feeling.

To this end, the invention provides an applicator device for applying a fluid or pasty product to keratin fibers or to the skin (epidermis), comprising an elongate core that extends along a longitudinal axis X and has a longitudinal cylindrical shape, a plurality of spikes distributed over said core, each spike extending from an end anchored in the core to a free end and being materially integral with said core, each spike having, at its free end, means for collecting and retaining a quantity of fluid or pasty product.

Thus, such a structure of the spike makes it possible to have distal retention of a quantity of product to be applied to the keratin fibers without the latter having to slide fully between the spikes. This gives its user optimal comfort while ensuring optimal application of product to the keratin fibers.

Advantageously, but optionally, the applicator device according to the invention has at least one of the following technical features:

- the collecting and retaining means comprise a first loop situated at the free end of the spike;
- each spike has a secondary extension protruding from the spike at a distance from the free end;
- the collecting and retaining means comprise a second loop formed by the secondary extension;
- the collecting and retaining means also have a lateral spur protruding from said each spike;
- the lateral spur is situated at one end of the first loop;
- the lateral spur is situated between and at a distance from the ends of the first loop;
- the collecting and retaining means partially delimit a reservoir intended to receive the quantity of fluid or pasty product; and
- each spike has, at its anchoring end, at a distance therefrom, second means for collecting and retaining a quantity of fluid or pasty product.

BRIEF DESCRIPTION OF THE FIGURES

Further features and advantages of the invention will become apparent from reading the following description of one embodiment of the invention. In the appended drawings.

For greater clarity, identical or similar elements are provided with identical reference signs throughout the figures.

DETAILED DESCRIPTION OF AN EMBODIMENT

Figure 1:
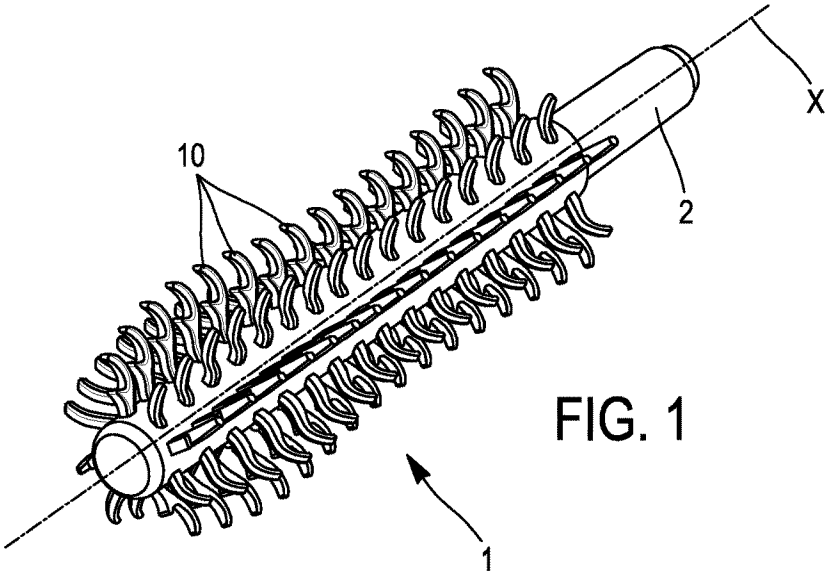
FIG. 1 shows a three-dimensional view of one embodiment of an applicator device according to the invention.

With reference to FIG. 1, an embodiment of an applicator device 1 will be described. The applicator device 1 according to the invention is, in this case, a mascara brush. It comprises, in this case, a core 2 which extends longitudinally along a longitudinal axis X. The core 2 may have a constant or nonconstant cross section along its length. In the most common embodiments, either the cross section is constant or the cross section decreases from a proximal end engaged with a tube and/or gripping handle to a distal free end. Generally, the core 2 has a cylindrical overall shape, preferably of revolution of axis the longitudinal axis X. Thus, the cross section of the core 2 may have a circular, polygonal, oval or other shape. It may be axisymmetric. The core 2 may be solid or hollow. A person skilled in the art will choose the most appropriate core depending on the economic and/or technical constraints.

Furthermore, the applicator device 1 according to the invention has a plurality of spikes 10 distributed over the core 2. The spikes 10 protrude from an external peripheral surface of the core 2. The spikes 10 are, for example, materially integral with the core 2. In particular, the spikes 10 are obtained by molding with the core 2. In this case, as illustrated, the spikes 10 are distributed in adjacent rows in pairs extending longitudinally in a manner parallel to the longitudinal axis X. The spikes 10 of one and the same row extend in the same way with one and the same orientation, parallel to one another, from the core 2. In this case, considering two adjacent rows, the spikes 10 of one of the adjacent rows are oriented differently than the spikes 10 in the other of the adjacent rows, for example, as illustrated in FIG. 1, at 180°. In a variant, the orientation is 90°.

Figure 4:
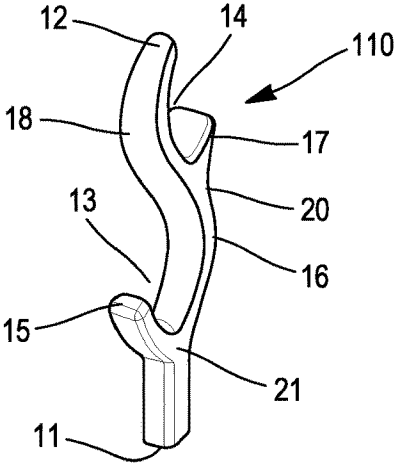
FIG. 4 is a three-dimensional view of the spike in FIG. 3.
Figure 3:
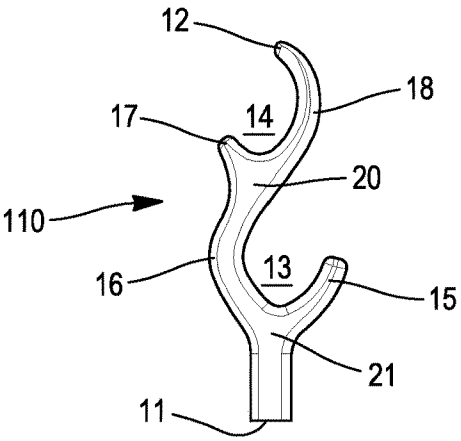
FIG. 3 is a side view of a spike according to a first embodiment for an applicator device according to the invention.

With reference to FIGS. 3 and 4, a first embodiment of a spike 110 intended for an applicator device according to the invention will be described. This spike 110 according to the invention has an anchoring end 11 and a free end 12. The anchoring end 11 is connected to the core 2 of the applicator device according to the invention. The spike 110 therefore extends from the anchoring end 11 to the free end 12, in this case generally in a plane which, in FIG. 3, is the sheet. From the anchoring end 11, the spike 110 according to the invention has, as illustrated here, a first body portion 16 curved in a first direction, then a second body portion 18 curved in an opposite direction, and then ends with the free end 12. This gives a reverse "S" shape of the body of the spike 110 according to the invention as illustrated in FIG. 3. The first body portion 16 is connected to the second body portion 18 at an end 20 common to the two body portions. The curved shape of the second body portion 18 forms a first loop situated at the free end 12.

Moreover, the spike 110 has a secondary extension 17 which protrudes from the spike 110 at the common end 20 of the two body portions 16, 18. In this case, this secondary extension extends in the plane of the spike 110. It forms a second loop which extends facing the first loop 18 and a curvature of which is opposite to that of the first loop. Thus, the first and second loops form collecting and retaining means and partially delimit a reservoir 14 intended to receive a quantity of fluid or pasty product. Thus, the first loop formed by the second body portion 18 makes it possible, during use of the applicator device 1 according to the invention, and in particular on passing through a wiper of said device 1 according to the invention, to protect the quantity of fluid or pasty product received in the reservoir 14: the spike is thus not cleared of said quantity of product.

In addition, the spike 110 has second means 13, 15, 16 for collecting and retaining a quantity of fluid or pasty product. These second collecting and retaining means are positioned at the anchoring end 11 of the spike 110, at a distance therefrom, while being situated below the above-described collecting and retaining means positioned at the free end 12 of the spike 110. The second collecting and retaining means in this case have a first loop formed by the first body portion 16 of the spike 110 and a second loop formed by a second secondary extension 15 which extends facing the first loop formed by the first body portion 16 and a curvature of which is opposite to that of this first loop. The secondary extension 15 protrudes from the spike 110 at a lower end 21 of the first body portion 16. In this case, this second secondary extension extends in the plane of the spike 110. Thus, the first body portion 16 and the second secondary extension 15 partially delimit a second reservoir 13 intended to receive a quantity of fluid or pasty product. Thus, the reservoir 14 is above the second reservoir 13 in the direction of extension of the spike 110.

Figure 5:
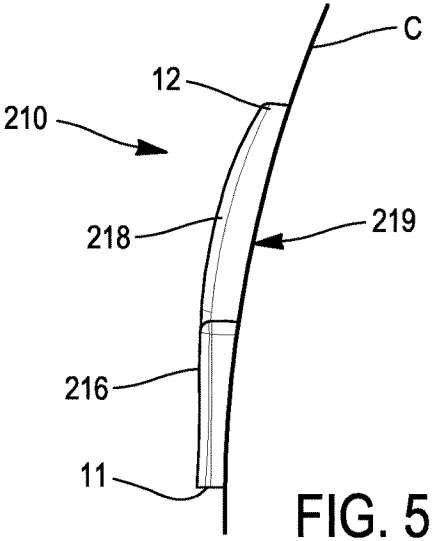
FIG. 5 is a frontal view of an embodiment variant of the spike in FIGS. 3 and 4.

Referring now to FIG. 5, an embodiment variant 210 of the above-described spike intended for an applicator device according to the invention will be described. The spike 210 of this variant has, from the anchoring end 11 to the free end 12, the first body portion 216 curved in a first direction, then the second body portion 218 curved in an opposite direction. In addition, the spike 210 has a lateral face 219 extending over the entire height of the spike 210 and bearing on a circle C. The circle C is in a plane which is perpendicular to the longitudinal axis X, an intersection point of the longitudinal axis X with the plane of the circle C being on the circle C. Such a configuration of the circle C supporting a face of the spike is described in detail in the document FR 2 937 514, to which reference may be made for more comprehensive information.

Figure 2:
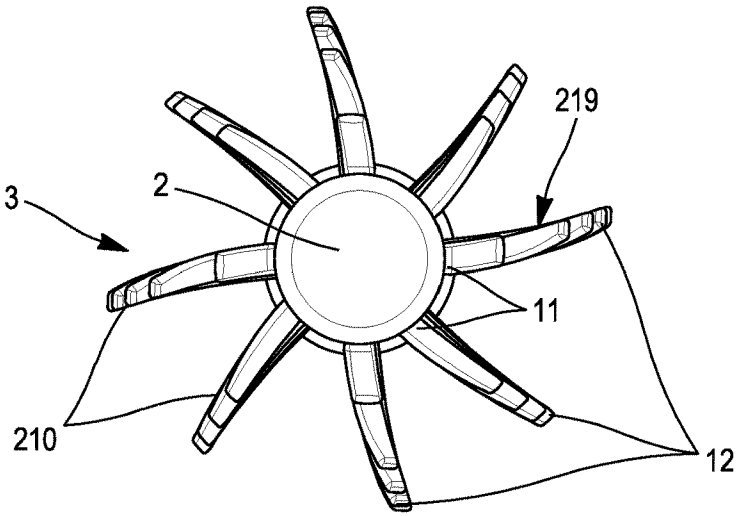
FIG. 2 is a frontal view of an embodiment variant of the applicator device in FIG. 1.

FIG. 2 illustrates an applicator device 3 according to the invention having rows of spikes 210.

Figure 8:
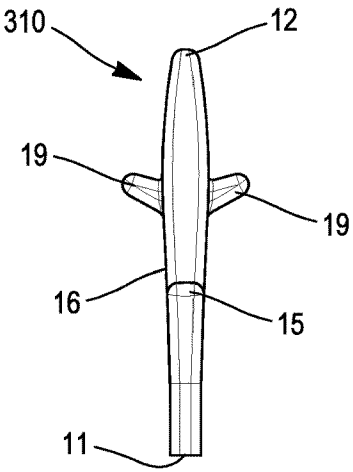
FIGS. 7 and 8 are side and frontal views of the spike in FIG. 6.
Figure 7:
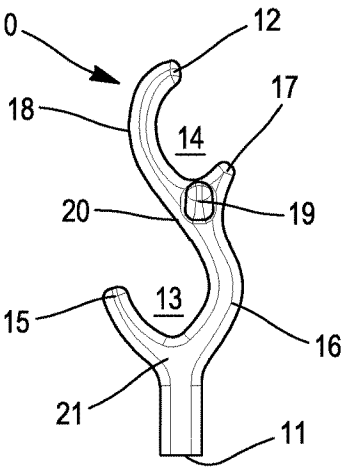
Figure 6:
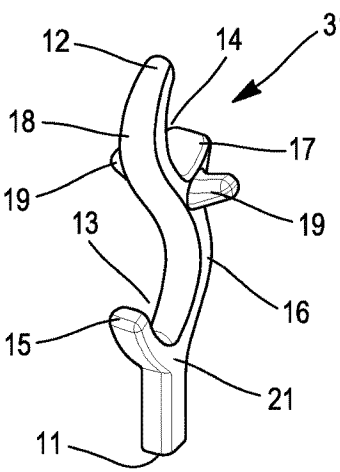
FIG. 6 is a three-dimensional view of a spike according to a second embodiment for an applicator device according to the invention.

With reference to FIGS. 6 to 8, a second embodiment of a spike 310 intended for an applicator device according to the invention will now be described. The spike 310 is structurally similar to the spike 110 described above. The spike 310 differs from the spike 110 in that the collecting and retaining means also have, in this case, two lateral spurs 19 that protrude from the spike 310. In this case, the two lateral spurs 19 extend on either side of the plane of the spike 310. The two lateral spurs 19 are implanted at the common end 20 and are, in this case, inclined upwardly. The lateral spurs 19 also partially delimit the reservoir 14. In an embodiment variant, the spike 310 has only one lateral spur 19. In another embodiment variant, the lateral spur(s) 19 extend(s) substantially horizontally.

Figure 9:
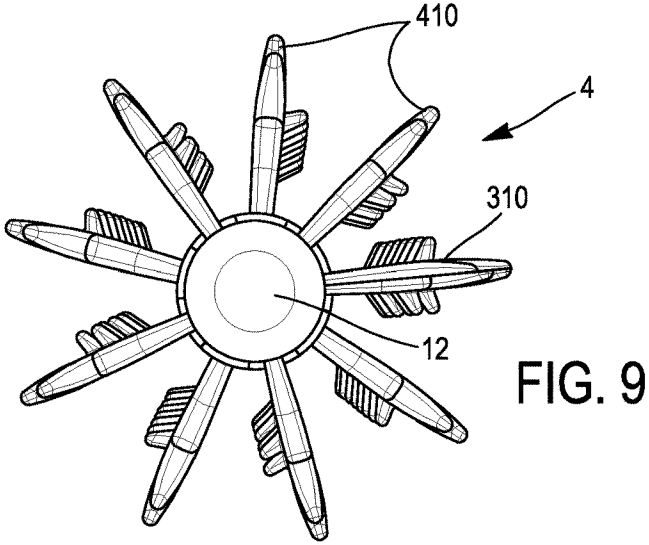
FIG. 9 is a frontal view of another embodiment of an applicator device according to the invention.

FIG. 9 illustrates an applicator device 4 according to the invention having rows of spikes 310 and rows of an embodiment variant of the spikes 410, which will now be briefly described.

Figure 11:
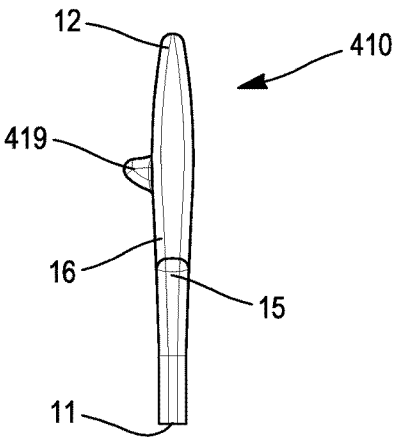
FIGS. 10 and 11 are side and frontal views of a spike according to a third embodiment for an applicator device according to the invention.
Figure 10:
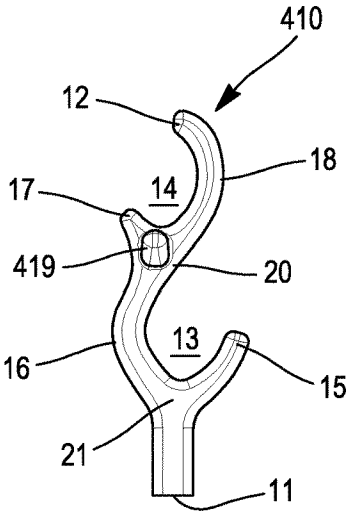

FIGS. 10 and 11 illustrate a third embodiment of a spike 410 intended for an applicator device according to the invention. The spike 410 is a variant of the spike 310 described above. It differs therefrom in that it has a single, short lateral spur 419 extending substantially horizontally. In an embodiment variant, the lateral spur 419 is similar to the lateral spur 19 of the preceding embodiment of the spike 310.

Figure 12:
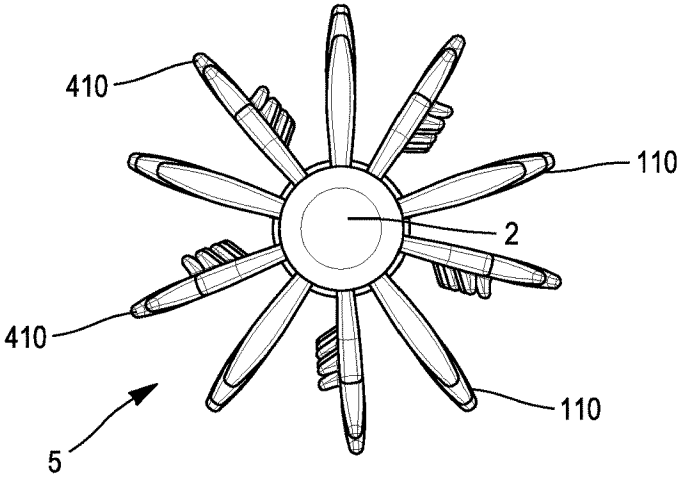
FIG. 12 is a frontal view of yet another embodiment of an applicator device according to the invention.
Figure 13:
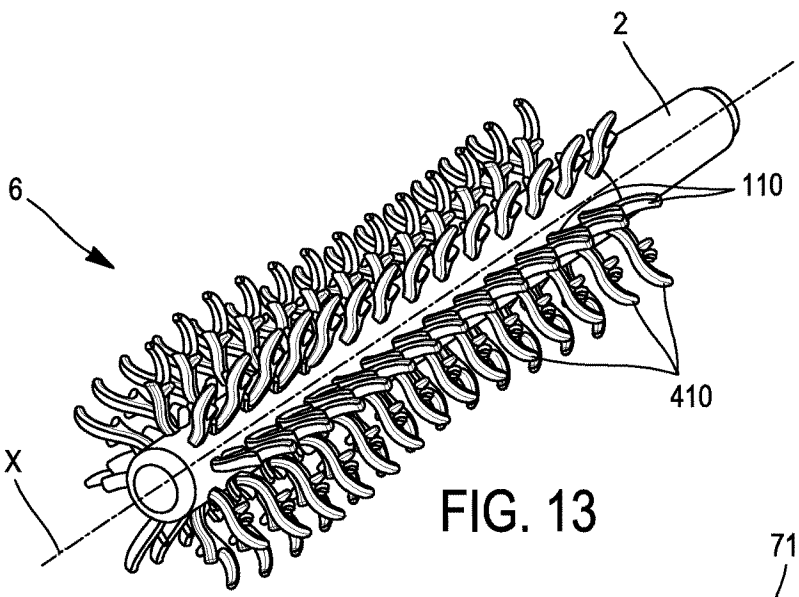
FIG. 13 is a three-dimensional view of an additional embodiment of an applicator device according to the invention.

FIG. 12 illustrates an applicator device 5 according to the invention having rows of spikes 110 and rows of an embodiment variant of the spikes 410. FIG. 13 illustrates an applicator device 6 according to the invention having rows of spikes 410 and rows of spikes 110 in a different arrangement. Further types of spikes according to the invention can be used and associated.

Figure 16:
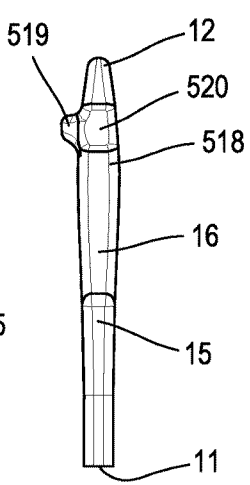
FIGS. 14, 15 and 16 are three-dimensional, side and frontal views of a spike according to a fourth embodiment for an applicator device according to the invention.
Figure 15:
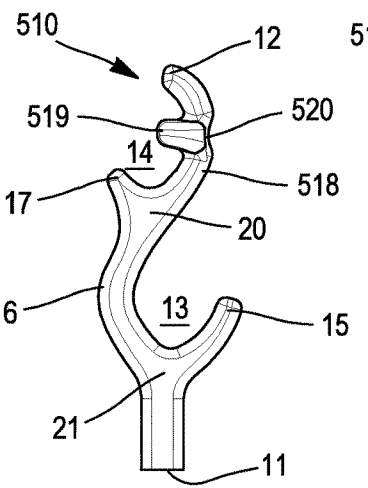
Figure 14:
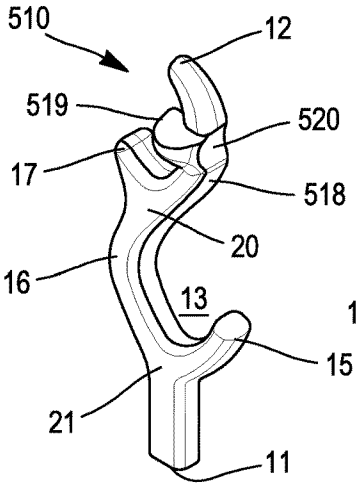

FIGS. 14 to 16 illustrate a fourth embodiment of a spike 510 intended for an applicator device according to the invention. The spike 510 differs from the spike 110 described above in that it has a lateral spur 519 that protrudes from the second body portion 518 of the spike 510, specifically at a distance from the free end 12 and from the common end 20, in particular substantially halfway between these two ends. The lateral spur 519 extends substantially horizontally and in the direction of the reservoir 14. In order to maintain a certain flexibility of the second body portion 518 at the implantation of the lateral spur 519, a notch 520 is provided in the thickness of the portion 518, in line with the lateral spur 519.

Figure 17:
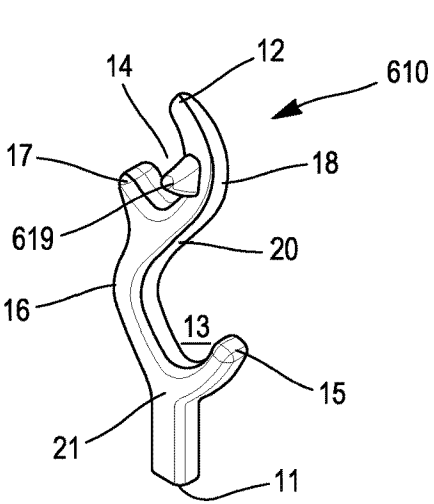
FIG. 17 is a three-dimensional view of an embodiment variant of the spike in FIGS. 14 to 16.

In an embodiment variant, a spike 610 intended for an applicator device according to the invention is illustrated in FIG. 17. The spike 610 differs from the previous spike 510 in that the lateral spur 619 is thinner and protrudes from the spike substantially horizontally and perpendicularly to the plane of the spike 610, in a similar manner to the lateral spur 419 of the spike 410 described above. On account of the thinness and the implantation of the lateral spur 619, it is no longer necessary to provide a notch in the thickness of the second body portion 18.

Figure 20:
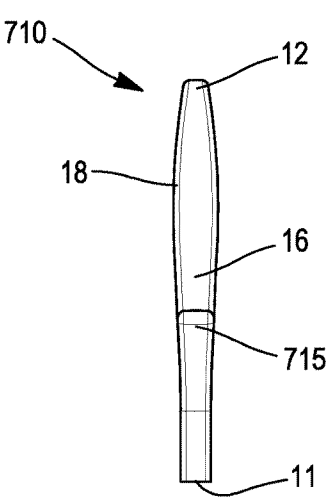
FIGS. 18, 19 and 20 are three-dimensional, side and frontal views of a spike according to a fifth embodiment for an applicator device according to the invention.
Figure 19:
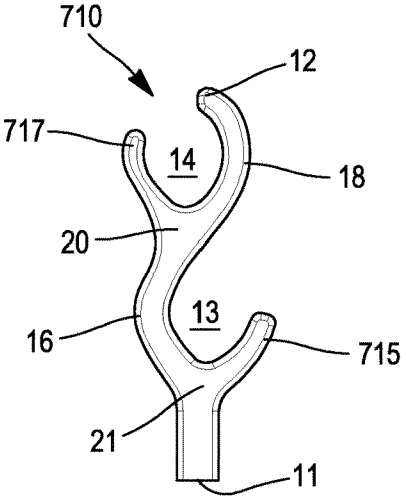
Figure 18:
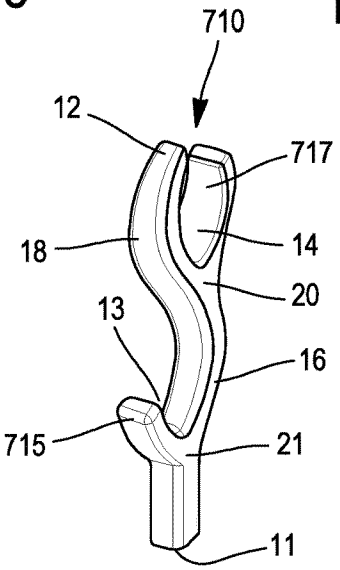

FIGS. 18 to 20 illustrate a fifth embodiment of a spike 710 for an applicator device according to the invention. This is an embodiment variant of the spike 110 described above. The spike 710 differs from the spike 110 in that the secondary extensions 715 and 717 have different sizes from those of the secondary extensions 15 and 17, respectively. In particular, the secondary extensions 717 and 715 are longer and thus make it possible to adapt the collecting and retaining means to products with a low viscosity, which are therefore more fluid.

It should be noted that, in the embodiments described above, the lateral spurs, which are part of the collecting and retaining means, also make it possible to partially delimit the reservoir 14 and to improve the take-up and retention of the quantity of fluid or pasty product.

Similarly, it is possible to provide lateral spurs which are identical to those described above at the second reservoir 13 and which are part of the second collecting and retaining means.

Generally, regardless of the embodiment of the applicator device according to the invention, at least the core 2 and the spikes are materially integral with one another so as to form a one-piece part. The core and the spikes are made of one or more materials of the thermoplastic, thermoplastic elastomer or vulcanizable material type, having different physical properties. Moreover, the core and the spikes are obtained with the aid of a molding process or an additive manufacturing process, for example of the stereolithography or three-dimensional printing type.

Of course, it is possible to make numerous modifications to the invention without departing from the scope thereof.

The invention claimed is:

1. An applicator device for applying a fluid or pasty product to keratin fibers or to the skin, comprising:

an elongate core that extends along a longitudinal axis X, wherein the elongate core includes, along the longitudinal axis X, a proximal end intended to engage with a tube and/or gripping handle and a distal end opposed to the proximal end;

a plurality of spikes distributed over the core, each spike extending from an end anchored in the core to a free end and being materially integral with the core, wherein at least one spike has, from the anchored end and in the following order, a first curved body portion with a concavity facing the distal end;

an extension protruding from a lower portion of the first curved body portion with a concavity facing the proximal end to define a first arc that partially delimits a reservoir intended to receive a quantity of fluid or pasty product; and a second curved body portion extending from the first curved body portion with a concavity facing the proximal end and terminating in the free end, such that the at least one spike is substantially in a reverse "S" shape.

2. The applicator device according to claim 1, wherein the at least one spike has a secondary extension protruding from the spike at a distance from the free end.

3. The applicator device according to claim 2, wherein the at least one spike comprises a second arc formed by the secondary extension.

4. The applicator device according to claim 3, further comprising a lateral spur protruding from the at least one spike.

5. The applicator device according to claim 4, wherein the lateral spur is situated at one end of the second arc.

6. The applicator device according to claim 4, wherein the lateral spur is situated between, and at a distance from, a proximal end of the secondary extension and the free end.

7. The applicator device according to claim 3, wherein the second arc partially delimits a second reservoir to receive fluid or pasty product.

8. An applicator device for applying a fluid or pasty product to keratin fibers or to the skin, comprising:

an elongate core that extends along a longitudinal axis X, wherein the elongate core includes, along the longitudinal axis X, a proximal end intended to engage with a tube and/or gripping handle and a distal end opposed to the proximal end;

a plurality of spikes distributed over the core, each spike extending from an end anchored in the core to a free end, wherein at least one spike has, from the anchored end and in the following order, a first curved body portion with a concavity facing the distal end;

an extension protruding from a lower portion of the first curved body portion with a concavity facing the proximal end to partially delimit, with the first curved body portion, a reservoir intended to receive a quantity of fluid or pasty product; and a second curved body portion extending from the first curved body portion with a concavity facing the proximal end and terminating in the free end such that the at least one spike has a reverse "S" shape, wherein the first arc comprises a lateral spur protruding from the at least one spike.

9. The applicator device of claim 8 wherein the lateral spur protrudes from the at least one spike substantially orthogonally to the longitudinal axis.

10. An applicator device for applying a fluid or pasty product to keratin fibers or to the skin, comprising:

an elongate core that extends along a longitudinal axis X, wherein the elongate core includes, along the longitudinal axis X, a proximal end intended to engage with a tube and/or gripping handle and a distal end opposed to the proximal end;

a plurality of spikes distributed over the core, each spike extending from an end anchored in the core to a free end, wherein at least one spike has, from the anchoring end, and in the following order, a first curved body portion with a concavity facing the distal end;

a second curved body portion with a concavity facing the proximal end and terminating in the free end; and an extension protruding from an end of the second curved body portion opposite the free end to define first arc to partially delimit a reservoir to receive a quantity of the fluid or pasty product.

11. The applicator device according to claim 10, wherein the at least one spike has a secondary extension protruding from a portion of the first curved body portion.

12. The applicator device according to claim 11, wherein the at least one spike comprises a second arc formed by the secondary extension.

13. The applicator device according to claim 10, further comprising a lateral spur protruding from the at least one spike.

14. The applicator device according to claim 13, wherein the lateral spur is situated at one end of the first arc.

15. The applicator device according to claim 13, wherein the lateral spur is situated between, and at a distance from, a proximal end of the extension and the free end.

* * * * *